United States Patent [19]

Werych

[11] 4,249,888

[45] Feb. 10, 1981

[54] INDUSTRIAL FURNACE WITH CERAMIC INSULATING MODULES HAVING INTERNAL GRID SUPPORT

[75] Inventor: Ewald R. Werych, Elm Grove, Wis.

[73] Assignee: General Signal Corporation, Stamford, Conn.

[21] Appl. No.: 28,084

[22] Filed: Apr. 9, 1979

[51] Int. Cl.[3] ..... F27D 1/16; F27D 1/06; F27D 1/14

[52] U.S. Cl. ..... 432/3; 110/332; 110/336; 432/247; 432/252

[58] Field of Search ..... 432/3, 247, 252; 110/331, 332, 336

[56] References Cited

U.S. PATENT DOCUMENTS

| | | | |
|---|---|---|---|
| 2,173,764 | 9/1939 | Parsons | 432/247 |
| 2,321,813 | 6/1943 | Henzel | 110/336 |
| 3,637,912 | 1/1972 | Bernard | 432/3 |
| 4,083,155 | 4/1978 | Lampert | 110/331 |

*Primary Examiner*—John J. Camby

*Attorney, Agent, or Firm*—Parmelee, Johnson, Bollinger & Bramblett

[57] ABSTRACT

An industrial furnace with insulating walls and roof comprising side-by-side pre-formed panels each including a plurality of ceramic insulating modules. The roof modules are suspended by a structure comprising a support grid embedded in situ in the ceramic module. The grid includes four holding rods each parallel to the corresponding side of the module. Hanger rods are attached to the grid at the corners thereof, and extend out from the module to pass through holes in the furnace roof member where the rods are secured in place by nuts. The module may also carry electric heating coil embedded in situ in the ceramic material adjacent the surface thereof facing the furnace interior.

9 Claims, 10 Drawing Figures

22
24
30
26
32
28

Fig. 6.
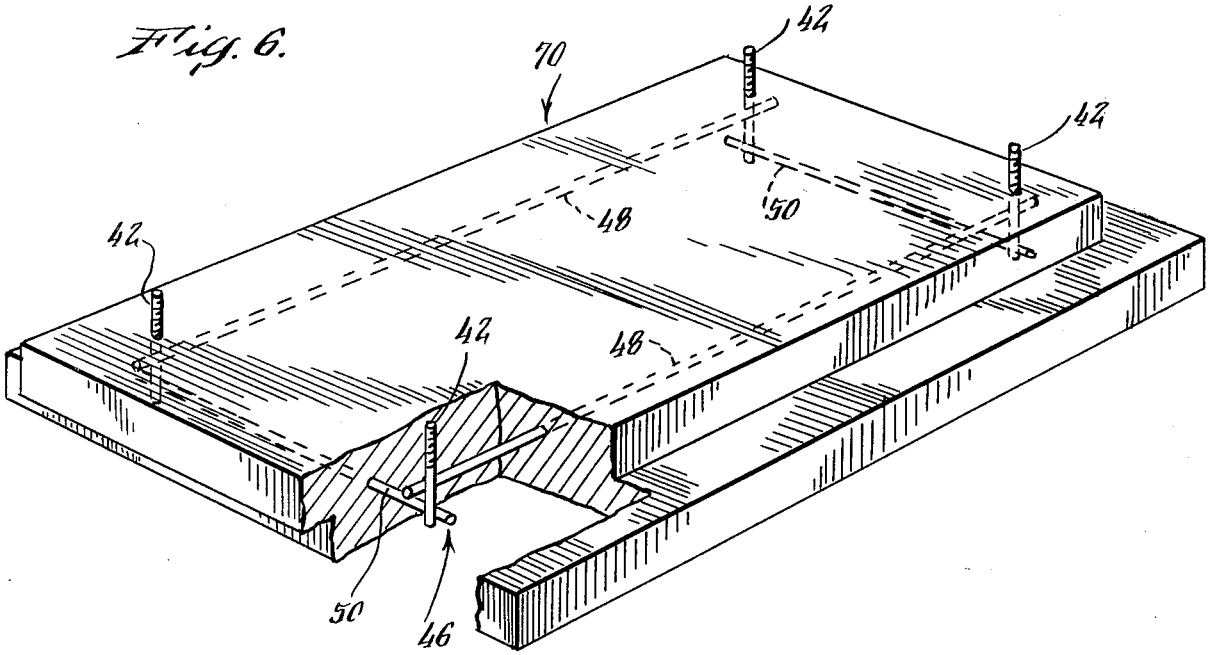
Fig. 7.
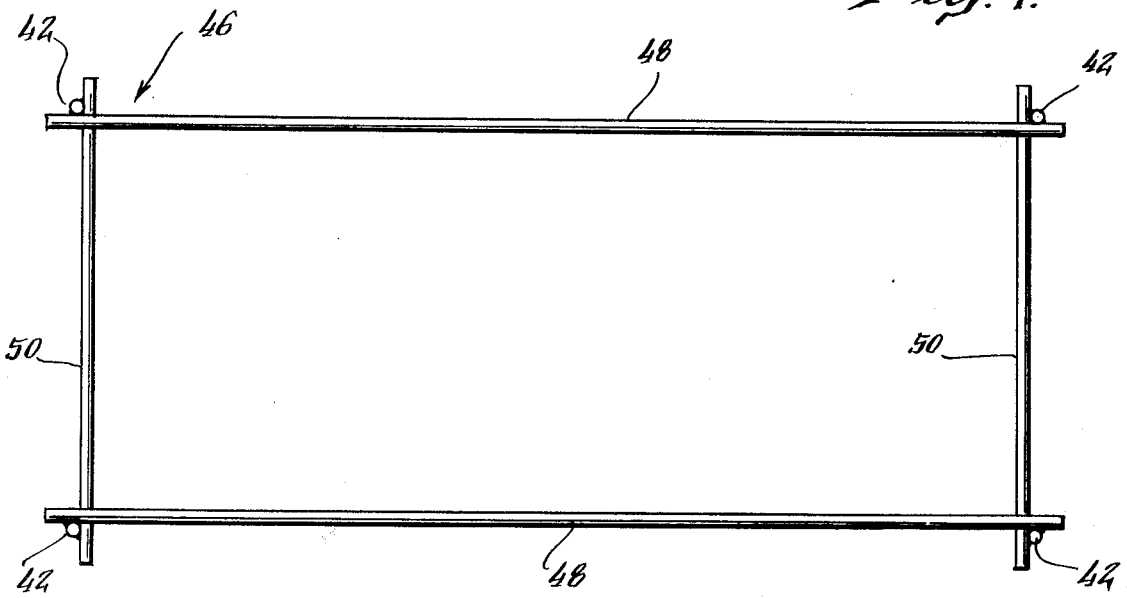
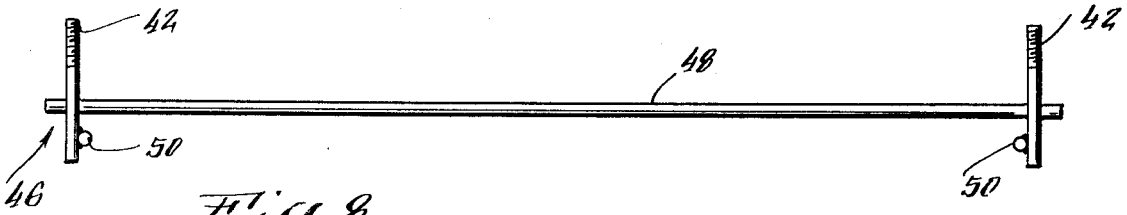
Fig. 8.

INDUSTRIAL FURNACE WITH CERAMIC INSULATING MODULES HAVING INTERNAL GRID SUPPORT

BACKGROUND OF THE INVENTION

1. Field of the Invention

This invention relates to industrial furnaces used for example in heat treatment processing of material. More particularly, this invention relates to such furnaces employing ceramic fiber insulation in the form of lightweight modules, and specifically is directed to means for securing such ceramic insulation modules to the roof of a furnace.

2. Description of the Prior Art

The use of ceramic fiber modules to insulate high-temperature industrial furnaces is advantageous for various reasons, especially because such construction affords significant savings in energy compared to the more conventional fire brick typically used for furnace linings. U.S. Pat. No. 3,500,444, issued to W. K. Hesse et al, discloses one type of lightweight ceramic module, and describes a vacuum process for molding such a module from a liquid suspension of an inorganic refractory fibrous material. Such modules may have an electrical heating element embedded in situ during the forming process. Alternatively, the modules may be used solely for insulation purposes, as in oil or gas fired furnaces.

Such lightweight ceramic insulation modules do not possess great mechanical strength. For that reason, difficulties have been encountered in securing the modules in place in a furnace. This is particularly true where it has been desired to suspend the modules from a furnace roof, because the entire weight of the module, including any embedded heater elements or the like, must be borne by the module support arrangement. The modules must be held securely in place during many years of use at high furnace temperatures, such as 2000° F. and above.

Accordingly, it is an object of this invention to provide improved means for mounting lightweight ceramic modules to the roof of an industrial furnace. A more specific object of the invention is to provide module support means which are capable of reliably supporting the entire weight of a module from the roof of a furnace, during long periods of high temperature conditions in the furnace. Other objects, aspects and advantages of this invention will in part be pointed out in, and in part apparent from, the following description considered together with the accompanying drawings.

SUMMARY OF THE INVENTION

In accordance with the invention in one of its aspects, a rod frame is embedded in situ in a ceramic fiber insulating module. The frame includes extensions which protrude beyond the surface of the insulating module and which may extend through and be fixed to a furnace structure.

According to the invention in another of its aspects, the embedded frame is a grid including legs extending generally normal to the surface of the insulating module and side and end rods interconnecting respective legs to complete the grid.

According to yet other aspects of the invention, the frame extensions are threaded so that, once they are passed through holes in a furnace roof, nuts may be placed on the threaded extensions to secure the insulating modules to the furnace roof.

Advantages of this invention include the capability of positively and securely suspending a ceramic insulating module from above, yet with no likelihood that the module will tear loose from the suspension. This result moreover is achieved without adhesives or the like, which tend to weaken at high temperatures.

BRIEF DESCRIPTION OF THE DRAWINGS

FIG. 6 is a perspective view of a ship-lap type of ceramic insulating module with an embedded support grid;

FIG. 7 is a plan view of the support grid for the module shown in FIG. 6;

FIG. 8 is an elevation view of the support grid of FIG. 7;

DESCRIPTION OF PREFERRED EMBODIMENTS

Figure 1:
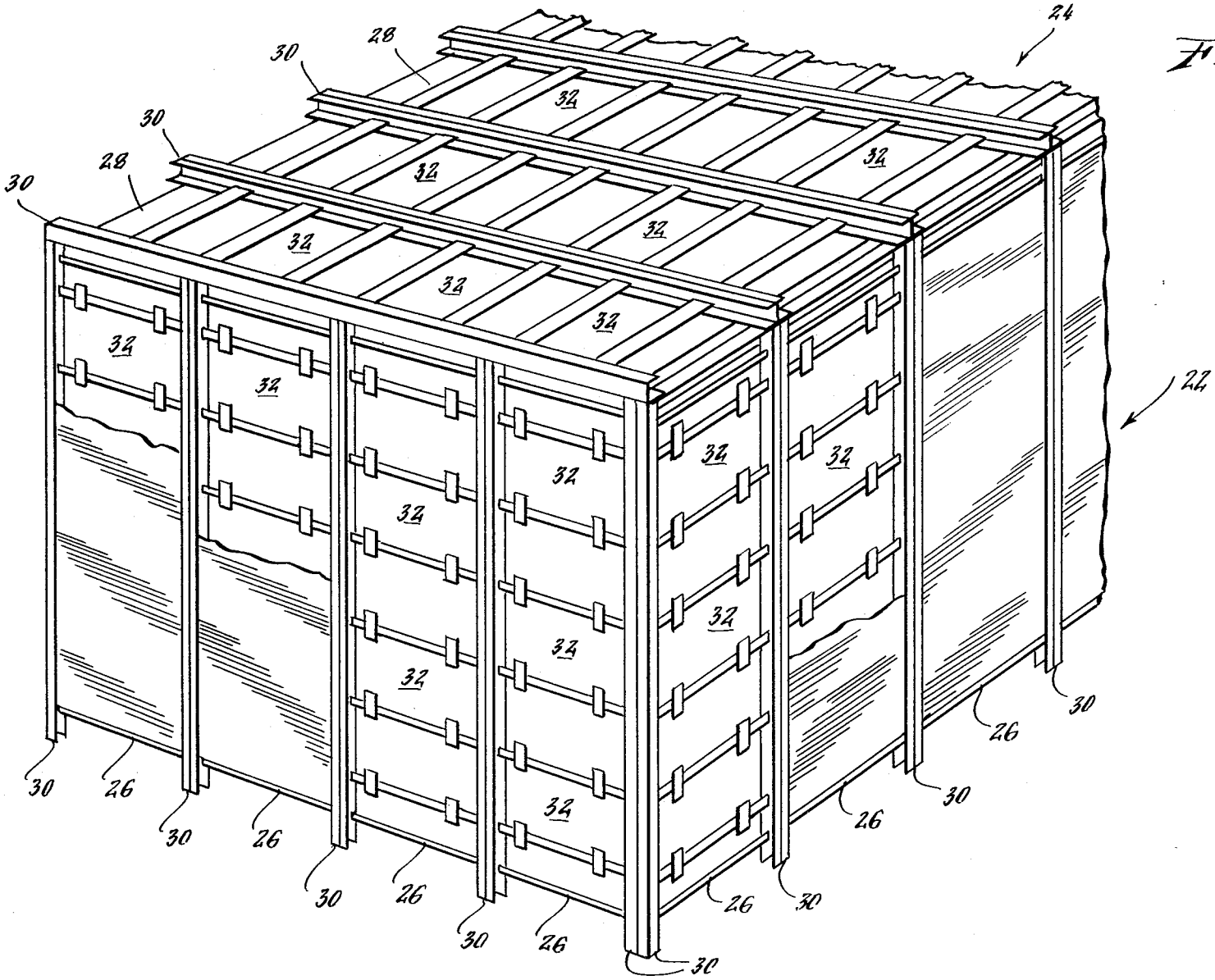
FIG. 1 is a perspective view showing an industrial furnace insulated with lightweight ceramic modules in both its side walls and its roof.

Referring now to FIG. 1, there is shown an industrial furnace 20 with its side walls generally indicated at 22 and its roof generally indicated at 24. The side walls and roof both are formed by side-by-side sets of panels 26 and 28. Each side panel 26 comprises a pair of vertical buck-stays 30 providing rigid support for a stacked group of generally rectangular insulation modules 32 constituted and produced as described hereinabove. Each roof panel 28 similarly comprises horizontal buck-stays 30 from which are suspended, as will be described, a corresponding group of insulation modules 32.

The modules 32 may be 36″ wide by 18″ high by 5″ deep, with the buck-stays 30 spaced correspondingly. The panels 26 and 28 form the basic standard side wall and roof components for furnaces of various sizes, in multiples of the nominal module width and height (e.g. 36″×18″). Typically these panels are factory assembled and pre-wired. Field erection then merely requires that the panels be bolted together and inter-panel insulation emplaced as described hereinafter. Such an arrangement particularly is advantageous for furnaces too large to be shipped completely factory assembled.

Figure 2:
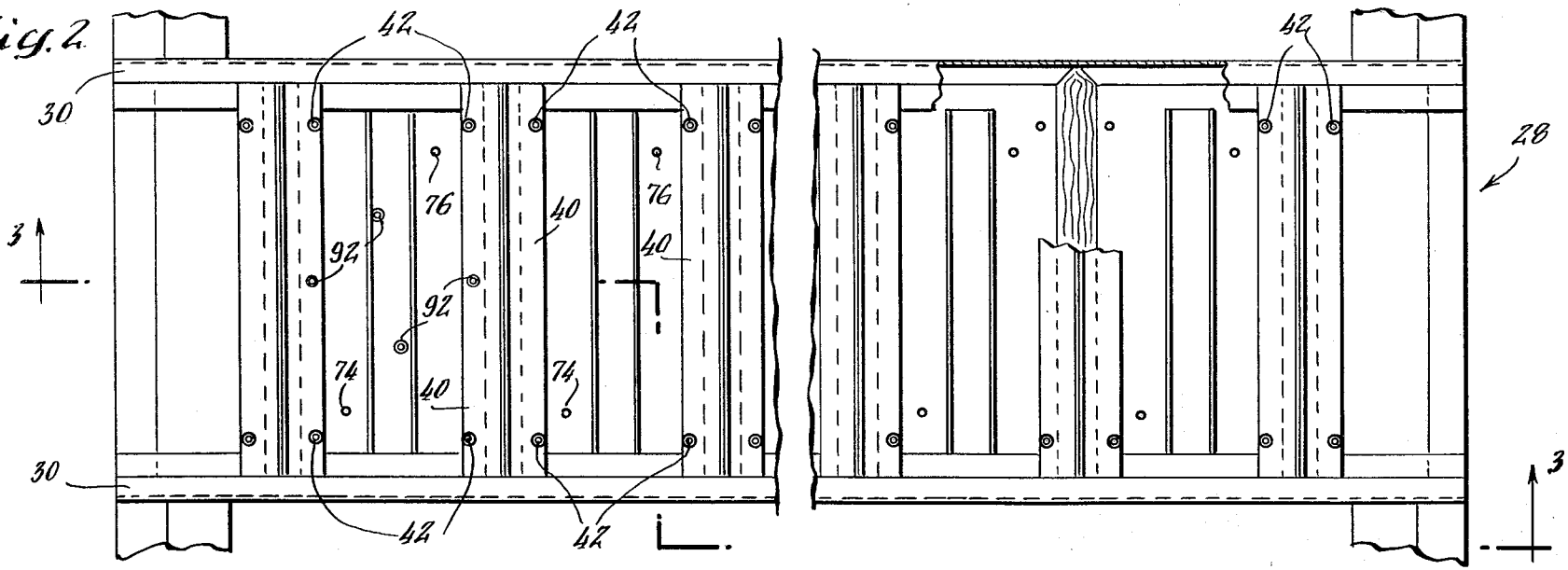
FIG. 2 is a plan view showing one roof panel carrying a set of insulation modules mounted side-by-side.
Figure 3:
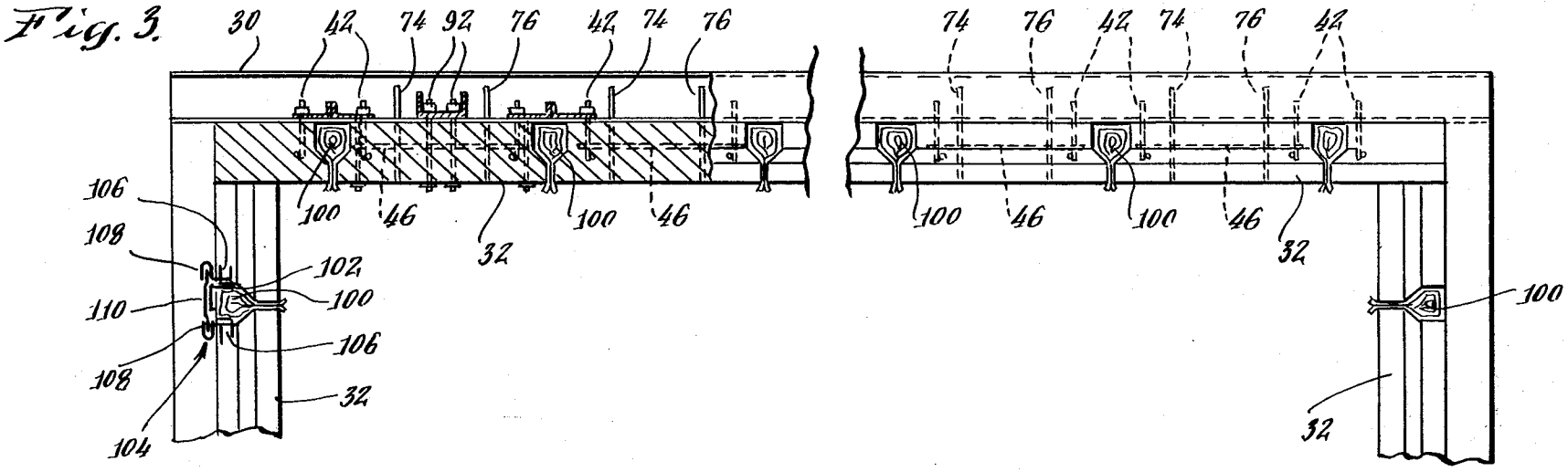
FIG. 3 is a section taken along line 3—3 of FIG. 2.

Referring now to FIGS. 2 and 3, each roof panel 28 comprises pairs of parallel cross-support members 40 secured to the buck-stays 30, and spaced apart by a distance commensurate with the width (e.g. 18″) of the associated module 32. These members 40 are formed near their ends with holes through which pass corresponding vertical hanger rods 42, threaded to receive nuts 44. The hanger rods 42 extend down into the ceramic module to a support grid or frame structure, generally indicated at 46, which is embedded in the module.

Figure 5:
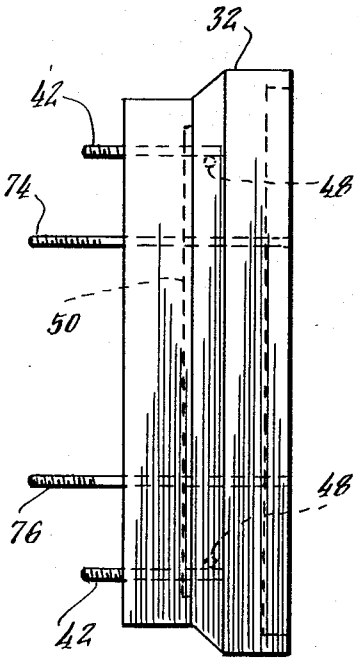
FIG. 5 is a side elevation view of the module of FIG. 4.
Figure 4:
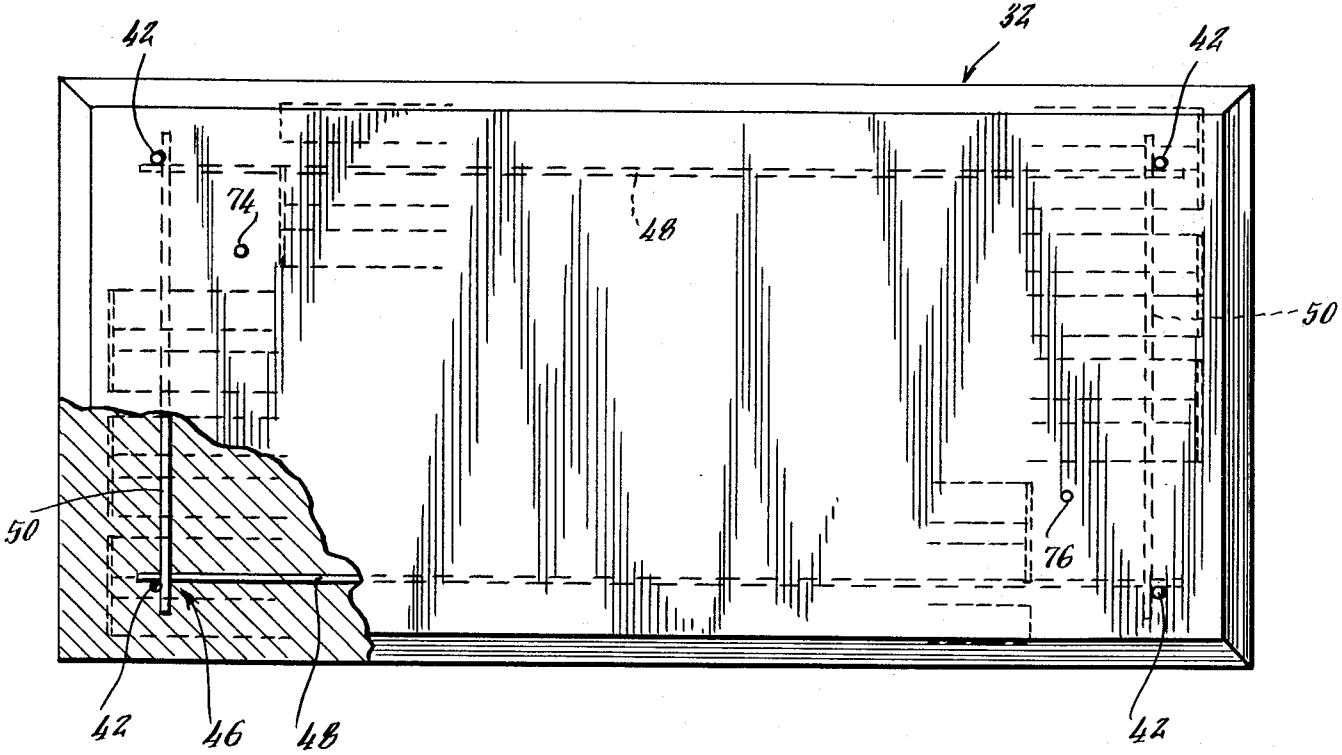
FIG. 4 is a plan view of one module.

Referring also to FIGS. 4 and 5, it will be seen that the support grid 46 basically comprises four holding rods arranged in a rectangular configuration. These rods include a first pair of parallel side rods 48 which are secured to a second pair of parallel end rods 50 perpendicular to the side rods. The plane of the second pair of rods is parallel to but slightly offset from the plane of the first pair. These embedded holding rods are securely fastened together as by welding at the four corners of the support grid. The four vertical hanger rods 42 also are welded to the support grid at the four corners respectively. These hanger rods extend out through the surface of each module, perpendicular to the surface thereof.

During the ceramic fiber molding process, the pre-welded support grid 46 with the hanger rods 42 is suspended in the mold at the proper level, and centered, with the holding rods 48, 50 positioned parallel to the corresponding sides of the modules, and the planes of each pair parallel to the module surface. The slurry then is drawn over the frame in the mold, and pressure differential (vacuum) is applied to draw the liquid out of the mold. After the liquid has been drawn from the mold, the support grid 46 remains firmly embedded in the ceramic fiber body.

It has been found that a support grid in the form of a frame structure as described above has excellent ability to hold the weight of a ceramic insulation module without significant risk of the module tearing away from the support grid. This capability appears to stem in part from the elongate nature of the separate holding rods. Each of these rods is nearly as long as the adjacent corresponding module side, with a consequent relatively broad distribution of the support load throughout a major portion of the module. Also, arranging the side and end pairs of rods in slightly offset planes (FIG. 5) further serves to distribute the support load into different shear planes of the module, thus tending to reduce stress concentrations so as to reduce the chance of tearing of the ceramic fiber insulation.

Referring now to FIG. 6, there is shown a perspective view of a support grid 46 embedded in a module 70 of somewhat different configuration, this time of ship-lap construction. As before, the side and end rods 48, 50 are parallel to the respective sides of the module. Details of the grid structure are shown in FIGS. 7 and 8.

Figure 9:
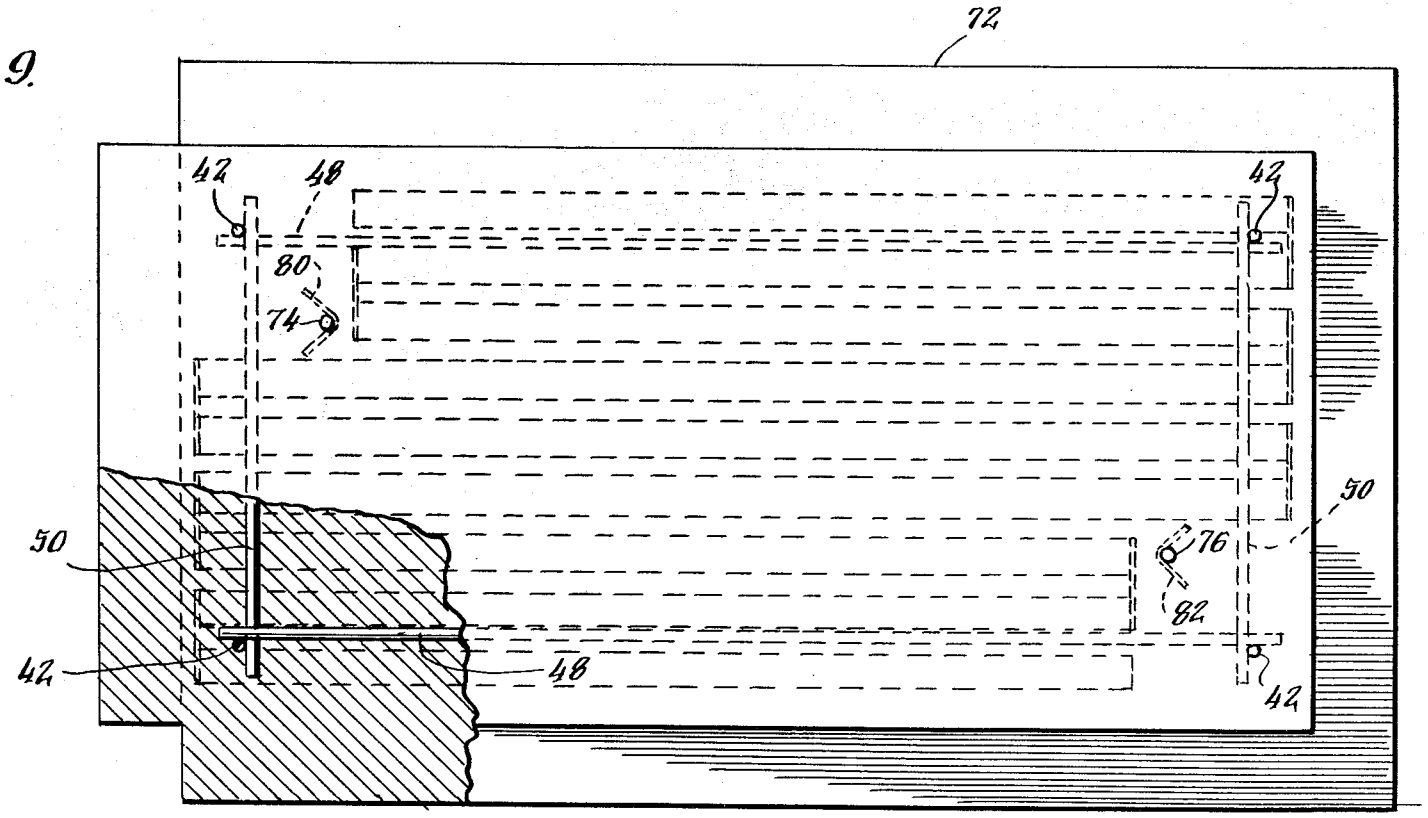
FIG. 9 is a plan view of another ceramic insulating module like that shown in FIG. 7, but including embedded heater coils.
Figure 10:
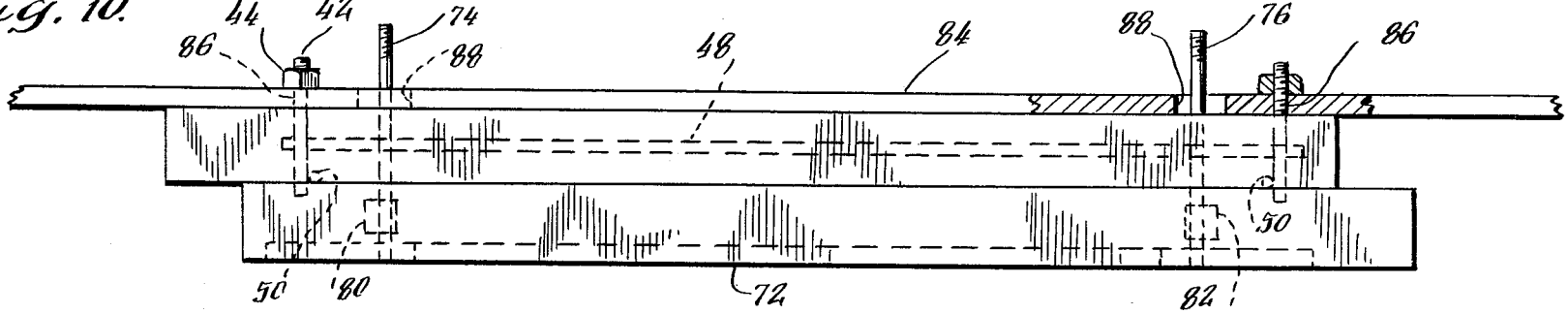
FIG. 10 is an elevation view, partly cut away, showing the module of FIG. 9 secured to a furnace roof structure.

FIGS. 9 and 10 show the support grid 46 embedded in a ship-lap module 70 like that of FIG. 6, but in this case also carrying an embedded heater coil 72, adjacent the surface which faces towards the interior of the furnace. As more fully discussed in my copending application Ser. No. 862,907, the coil 72 comprises a set of series-connected side-by-side sections adapted to be coupled to an electric power source by means of terminal pins 74, 76 which extend through the ceramic insulating body and protrude through the upper surface 78. The terminal pins may be anchored to the ceramic fiber body by anchoring ribbons 80, 82 secured to the pins.

When either of the ceramic fiber insulating modules 42 or 70 is to be secured to the inside of a furnace roof member 84 (FIG. 10), holes 86 are drilled through the furnace roof member at the same relative positions as the threaded hanger rods 42 for the support grid 46. For a module having terminal pins, two clearance holes 88 are drilled through the furnace roof member at the proper relative positions. The insulating module is then positioned upwardly against the furnace roof member 84 so that the threaded extensions of the hanger rods (and the terminal pins of the heater coil) pass through their respective holes. With the threaded portions extending beyond the furnace roof member, nuts 44 are placed on the threaded extensions to securely fasten, at four points, the ceramic fiber, insulating module to the roof. Where an electric heating coil is provided, the terminal pins can then be connected to the electric power source.

It will be apparent that ceramic fiber insulating modules having support grids embedded therein in situ, and having electric heating coils embedded therein, may be quickly and easily secured to a furnace roof. The furnace roof need not be solid before being lined with insulation modules, and as shown may be a simple framework with the insulation completing the enclosure. For applications making use of very large ceramic modules, it may be desirable to limit any possible sagging by adding ceramic stud retainers 92 of conventional construction, as shown in FIG. 3.

The space between adjacent modules 32 is filled by a rolled insulation blanket 100 which serves to block off what otherwise would be a high heat-loss channel resulting from a straight-through joint. This blanket preferably is formed of inorganic fibrous ceramic material, but without binding agents as employed in the liquid slurry used to make the rigid ceramic modules 32. The blanket thus is sufficiently flexible so that it can easily be rolled into a relatively tightly compressed shape, as shown in the drawings. Similarly rolled blankets are inserted between the side edges of ceramic modules in adjacent panels.

The side wall panels 26 also include rolled insulation blankets 100 between adjacent modules 32, for the same purpose. The side wall modules may however be held in place by a different support structure. In the disclosed embodiment (see FIG. 3), this structure includes cross-support members 102 of inverted L-shape (in cross-section), so arranged that the flat horizontal surface of each cross-member provides support for the module immediately above. Retainers 104 having sharp prongs 106 are inserted into each module. These retainers also include spring clips 108 which receive and grip lock-bars 110 serving to secure the modules in position.

While the invention has been particularly shown and described with reference to specific preferred embodiments thereof, it will be understood by those skilled in the art that various changes in form and details may be made therein without departing from the spirit and scope of the invention as defined by the appended claims. For example, different grid configurations suited to special applications may be employed. Also, although the support grid is shown used only for roof modules, the grid support arrangement may, if desired, be used for side wall modules.

What is claimed is:

1. An industrial furnace used for heat treatment or the like and comprising:

panel means including a plurality of ceramic fiber insulating modules;

each of said modules having interiorly thereof a support frame with a plurality of interconnected rods embedded in situ in the ceramic fiber insulating body;

spaced means securely connected to said support frame and protruding outwardly through a surface of said insulating body which is remote from the interior of said furnace; and means secured to said spaced means for securing said modules to said furnace.

2. A furnace as claimed in claim 1, wherein said spaced means include extensions threaded to receive nuts.

3. A furnace as claimed in claim 1, wherein said spaced means comprise a plurality of legs extending generally normal to said surface of said insulating body and protruding outwardly from said surface to form extensions;

said support frame comprising a plurality of holding rods extending between and secured to respective ones of said legs.

4. A furnace as claimed in claim 3, wherein said extensions are threaded to receive nuts.

5. An industrial furnace used for heat treatment or the like and comprising:

panel means including a plurality of ceramic fiber insulating modules;

each of said modules having interiorly thereof a support frame with a plurality of interconnected rods embedded in situ in the ceramic fiber insulating body;

spaced means connected to said support frame and protruding outwardly from a surface of said insulating body;

said spaced means comprising four legs extending generally normal to said surface of said insulating body and protruding outwardly from said surface to form extensions;

said support frame comprising:

a first side rod extending between and secured to first and second ones of said legs and a second side rod extending between and secured to third and fourth ones of said legs;

a first end rod extending between and secured to said first and third legs and a second end rod extending between and secured to said second and fourth legs and means secured to said legs for securing said modules to said furnace.

6. A furnace as claimed in claim 5, wherein said extensions are threaded to receive nuts.

7. A ceramic fiber insulating module for use in industrial furnaces comprising:

a grid including a plurality of interconnecting rods embedded in situ in said ceramic fiber insulating body;

said grid including spaced extensions protruding outwardly from a surface of said ceramic fiber insulating body for securing said module to a furnace wall;

said extensions being formed on legs extending generally normal to said surface of said insulating body and threaded to receive module securing nuts;

said rods comprising a first side rod extending between and secured to first and second ones of said legs and a second side rod extending between and secured to third and fourth ones of said legs, said first and second side rods lying within a side rod plane generally parallel to said surface of said insulating body; and said rods further comprising a first end rod extending between and secured to said first and third legs and a second end rod extending between and secured to said second and fourth legs, said first and second end rods lying within an end rod plane generally parallel to said surface of said insulating body but offset from said side rod plane.

8. The method of insulating a furnace wall comprising the steps of:

providing a ceramic fiber insulating module including a rod frame embedded in situ in a ceramic fiber insulating body, extensions of said frame protruding outwardly from a surface of said fiber insulating body;

providing holes in said furnace wall to receive said extensions;

positioning said ceramic fiber insulating module against said furnace wall with said extensions protruding through said holes; and securing said extensions to said furnace wall from the side of the furnace wall opposite to said positioned fiber insulating module.

9. The method of insulating a furnace wall as claimed in claim 8 wherein said extensions are threaded and said extensions are secured to said furnace wall by placing nuts on said threaded extensions.

* * * * *